US006454140B1

(12) United States Patent
Jinks

(10) Patent No.: US 6,454,140 B1
(45) Date of Patent: Sep. 24, 2002

(54) METERED DOSE DISPENSING AEROSOL VALVE

(75) Inventor: Philip A. Jinks, Loughborough (GB)

(73) Assignee: 3M Innovative Properties Companies, St. Paul, MN (US)

( * ) Notice: Subject to any disclaimer, the term of this patent is extended or adjusted under 35 U.S.C. 154(b) by 0 days.

(21) Appl. No.: 09/907,204

(22) Filed: Jul. 17, 2001

Related U.S. Application Data

(60) Provisional application No. 60/221,421, filed on Jul. 28, 2000.

(51) Int. Cl.[7] ..... B65D 83/14
(52) U.S. Cl. ..... 222/402.2
(58) Field of Search ..... 222/402.2

(56) References Cited

U.S. PATENT DOCUMENTS

| | | | | |
|---|---|---|---|---|
| 3,499,584 A | * | 3/1970 | Warren | 222/402.2 |
| 3,756,474 A | | 9/1973 | Riccio | |
| 4,135,648 A | | 1/1979 | White | 222/402.2 |
| 4,506,803 A | * | 3/1985 | Franklin et al. | 222/402.2 |
| 4,858,790 A | * | 8/1989 | Howlett | 222/402.2 |
| 4,863,073 A | * | 9/1989 | Burt et al. | 222/402.2 |
| 4,919,312 A | | 4/1990 | Beard et al. | 222/402.2 |
| 5,037,012 A | * | 8/1991 | Langford | 222/402.2 |
| 5,169,038 A | * | 12/1992 | Di Giovanni | 222/402.2 |

FOREIGN PATENT DOCUMENTS

| | | |
|---|---|---|
| EP | 0692434 A2 | 1/1996 |
| GB | 2206860 A | 1/1989 |
| GB | 2345279 A | 7/2000 |

* cited by examiner

*Primary Examiner*—Kenneth Bomberg
(74) *Attorney, Agent, or Firm*—Ted K. Ringsred; Robert W. Sprague

(57) ABSTRACT

A metered dose aerosol valve that minimizes loss of prime and loss of drug dose by having a one-way valve mechanism positioned toward the end of a transfer passage that allows drug substance to pass from the aerosol container into the metering chamber, but not back.

11 Claims, 5 Drawing Sheets

METERED DOSE DISPENSING AEROSOL VALVE

Figure 2:
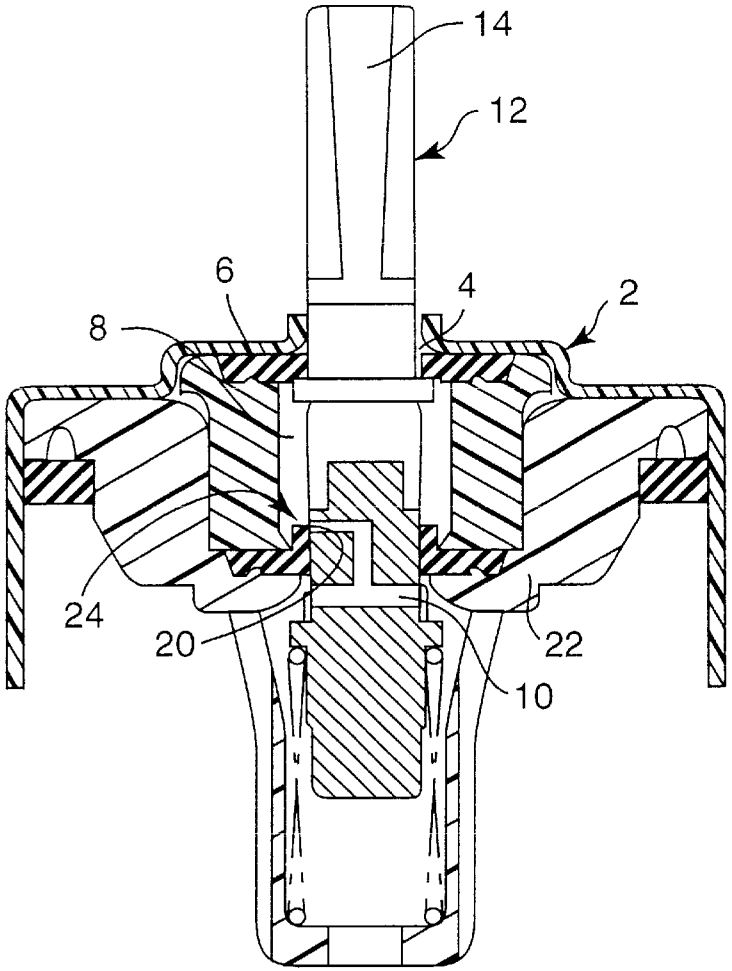

This application claims priority to U.S. provisional application No. 60/221421, filed Jul. 28, 2000.

FIELD OF THE INVENTION

This invention relates to metered dose dispensing aerosol valves and in particular to metered dose dispensing valves suitable for use with metered dose inhalers.

BACKGROUND TO THE INVENTION

Conventional metering valves for use with pressurised dispensing containers comprise a valve stem co-axially slidable within a valve member defining an annular metering chamber and outer (diaphragm) and inner (tank) annular seals co-operative between the respective outer and inner ends of the valve stem and the valve member to seal the metering chamber therebetween. The valve stem is movable between a non-dispensing position in which the metering chamber is connected to the container and charged with product therefrom. The valve stem is movable, generally against the action of a spring, to a dispensing position where the metering chamber is isolated from the container and vented to the atmosphere for discharge of the product.

Loss of prime and loss of dose are dosing anomalies that are commonly encountered with metered dose inhalers. Loss of prime occurs when vapour or air gets trapped in the metering chamber. Unless primed immediately before actuation, the time since the previous actuation can be major variable as can the conditions under which the product has been stored; such as unit orientation and temperature. The after phenomenon is partly as a result of drug substance in the metering chamber being lost from the chamber prior to actuation of the valve. Drug substance may be lost from the metering chamber due to the ability of the active substance to migrate into and out of the metering chamber during the storage period.

EP-A-0692434 discloses an aerosol valve having flow passages connecting the metering chamber to the container when the valve stem is in its rest position and having an annular gap which is dimensioned to allow flow from the container into the metering chamber but is sufficiently small so that capillary forces prevent liquid from flowing through the gap under only gravitational force. However, this arrangement would not prevent passage of sedimented material out of the metering chamber into the region of the valve between the metering chamber and the annular gap. Also, it is difficult to mass produce valves to the tolerances required to ensure effective operation of such a valve. In other embodiments of EP-A-0692434 the valves are designed so that the metering chamber is completely sealed when the valve stem is in its rest position and the metering chamber is only filled when the valve stem is intermediate between its rest and firing positions.

GB-A-2206860 and GB-A-2345279 disclose valves having a mechanical one-way valve positioned in an enclosed pre-metering region which allows the metering chamber to be filled in the rest position of the valve stem but prevents material leaving the pre-metering region of the valve to the container. However, the arrangement does not prevent passage of sedimented material from the metering chamber to the pre-metering region of the valve.

SUMMARY OF THE INVENTION

It is desirable to provide a metered dose dispensing aerosol valve in which the problems of loss of prime as well as loss of dose are substantially reduced.

According to the present invention there is provided a metered dose dispensing aerosol valve for a container comprising a valve body defining an aperture, a seal mounted at the aperture, a metering chamber, a tank seal, a transfer passage through which a quantity of substance to be dispensed can pass from the container into the metering chamber and a valve stem having a dispensing passage, the valve stem being slideably moveable through the seal such that in a first position the dispensing passage is isolated from the metering chamber and the metering chamber is in communication with the container via the transfer passage and in a second position the dispensing passage is in communication with the metering chamber to allow substance to be dispensed from the metering chamber through the dispensing passage and the transfer passage is isolated from the metering chamber, and the valve stem extending, at least in the second position, through the tank seal, wherein the transfer passage comprises a mechanical flow valve positioned towards the end of the transfer passage adjacent the metering chamber, which in said first position, allows substance to be dispensed to pass from the container into the metering chamber but not out of the metering chamber.

The invention provides a one-way flow valve which freely allows substance to enter the metering chamber from the container when the valve stem is in its first (rest) position but provides a barrier to prevent substance leaving the metering chamber. Thus, after actuation and the valve stem is returned to its rest position, the metering chamber is immediately charged from the container and thereafter migration of substance from the metering chamber is prevented. More particularly, the mechanical flow valve is normally biased into a closed, sealed state and is displaceable when the valve stem is in its first position to allow substance to be dispensed to pass from the container into the metering chamber, and once the metering chamber is filled, the flow valve returns to its sealed state. Thus, loss of prime and loss of dose is substantially reduced or eliminated.

In one embodiment of the invention the transfer passage is formed within the valve stem and has an outlet from the valve stem which is positioned within the metering chamber when the valve is in the first position. The flow valve conveniently comprises a displaceable seal positioned at said outlet which may be in the form of an elastomeric sleeve or ring extending around the valve stem.

In a second embodiment the transfer passage is formed within the valve stem and has an outlet from the valve stem which is positioned within the metering chamber when the valve is in the first position. The valve stem extends in the first position through the metering chamber in sealing engagement with the tank seal and the tank seal is configured to provide a displaceable elastomeric seal over said outlet from the valve stem of the transfer passage.

In a further embodiment, the valve stem is in sealing engagement with the tank seal, at least in its second position, and the transfer passage is defined between the tank seal and the valve stem when the valve is in its first position. The transfer passage may be annular, being formed completely around the valve stem or the valve stem may have a cut away portion to form the transfer passage. In either case the valve stem may have an elastomeric stem seal secured thereto, which may seal against the tank seal but is displaceable to allow passage of substance from the container through the transfer passage into the metering chamber.

In a further embodiment the inner end of the valve stem has a seal support plug secured thereto, the seal support plug extending through a tank seal in sealing engagement therewith when the valve stem is in said first position, the sealing support plug having one or more apertures forming said transfer passage which are covered by a displaceably annular elastomeric seal located between the top surface of the seal support plug and the inner end of the valve stem.

DESCRIPTION OF PREFERRED EMBODIMENTS

Figure 1:
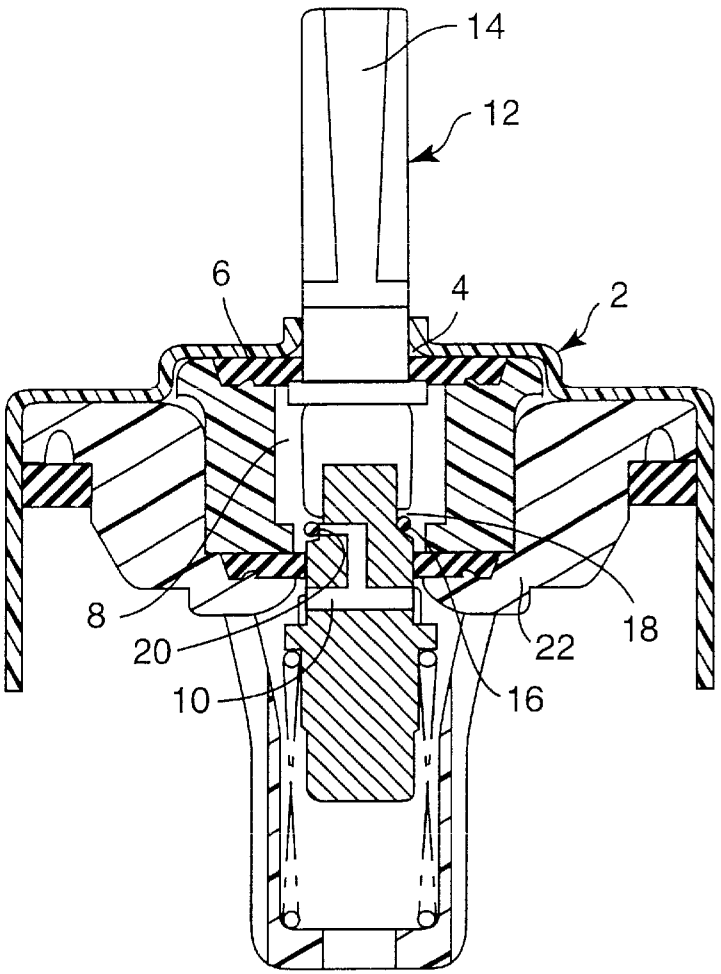
Figure 3A:
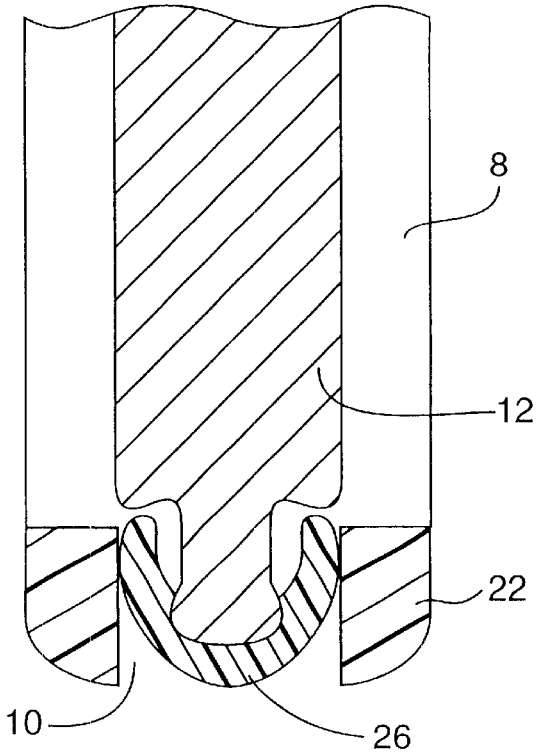
Figure 3B:
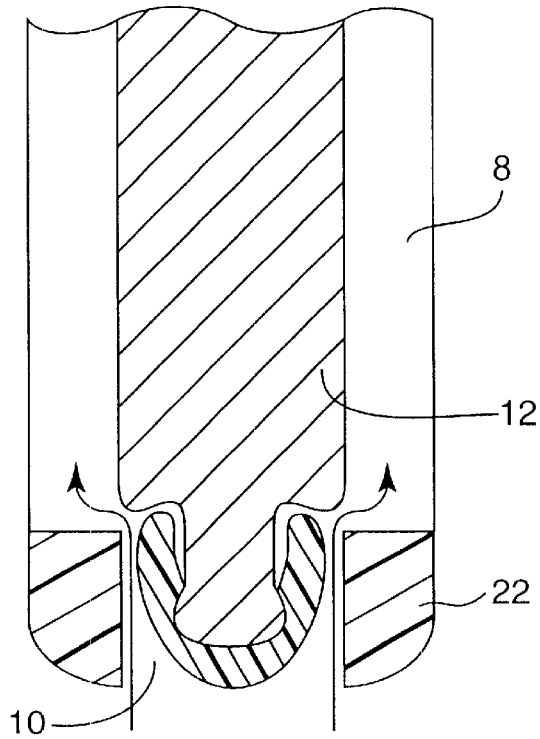
Figure 4:
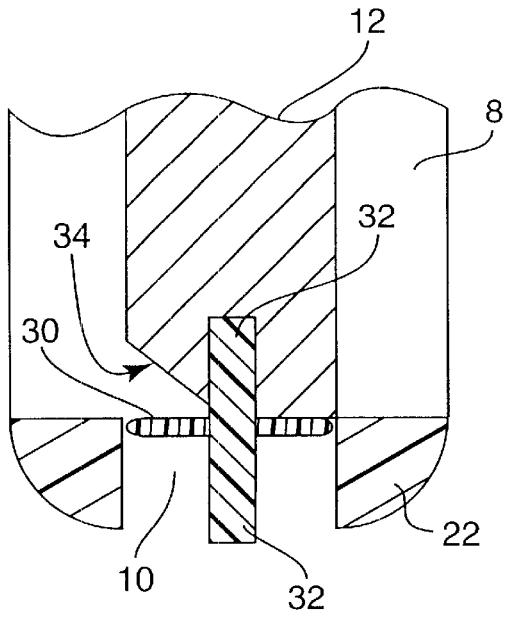
Figure 5A:
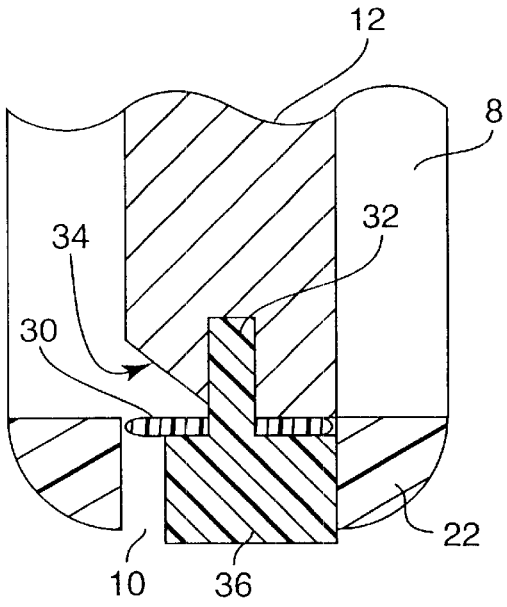
Figure 5B:
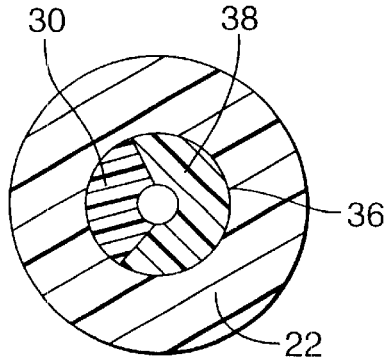
Figure 6A:
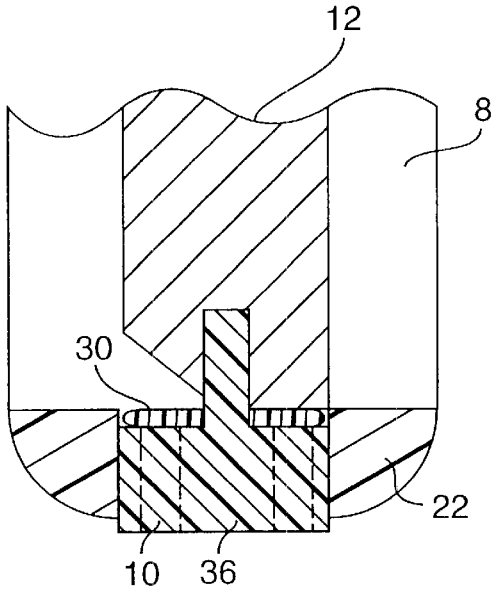
Figure 6B:
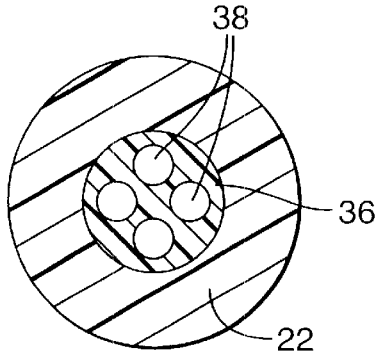
Figure 7A:
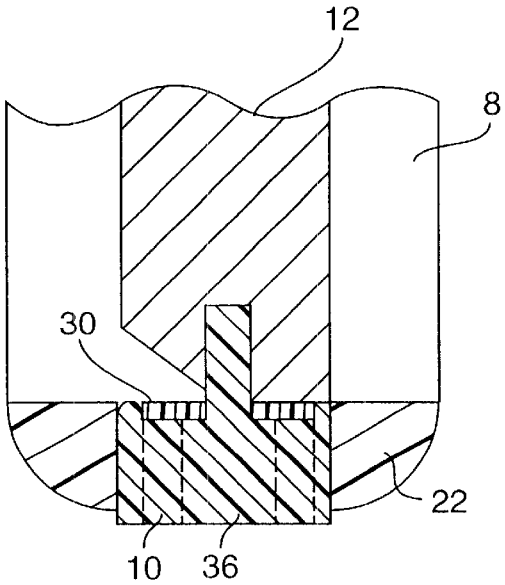
Figure 7B:
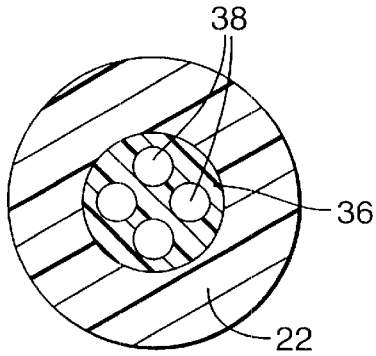
Figure 8A:
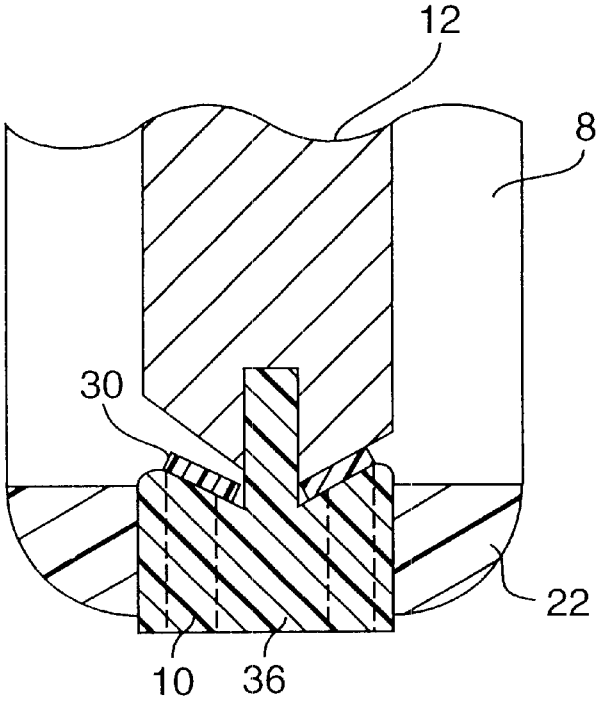
Figure 8B:
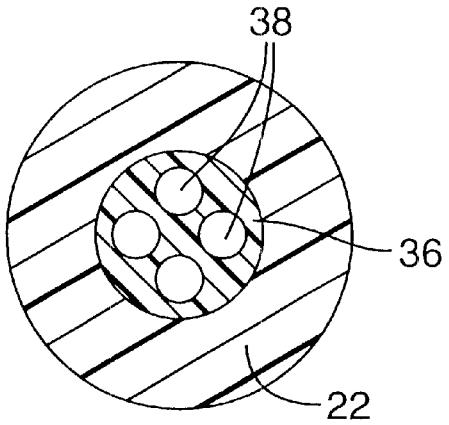

The invention will now be described with reference to the accompanying drawings in which:

FIG. 1 represents a cross-section through a metered dose dispensing aerosol valve in accordance with the invention, FIG. 2 represents a cross-section through a further metered dose dispensing aerosol valve in accordance with the invention, FIGS. 3*a* and 3*b* represent cross-sections through part of a metering chamber and valve stem suitable for use in a valve in accordance with the invention, FIG. 4 represents a cross-section through part of a metering chamber and valve stem suitable for use in a valve in accordance with the invention, FIGS. 5*a* and 5*b* represent a cross-section and end view of a portion of a metering chamber and valve stem suitable for use in a valve in accordance with the invention, FIGS. 6*a* and 6*b* represent a cross-section and end view of a portion of a metering chamber and valve stem suitable for use in a valve in accordance with the invention, FIGS. 7*a* and 7*b* represent a cross-section and end view of a portion of a metering chamber and valve stem suitable for use in the invention and FIGS. 8*a* and 8*b* represent a cross-section and end view of a portion of a metering chamber and valve stem suitable for use in the invention.

In the discussion of the accompanying drawings, like numerals represent like parts.

Referring to FIG. 1, a metered dose dispensing aerosol valve comprises a valve body (2) defining an aperture (4), a seal (6) mounted at the aperture, a metering chamber (8), a transfer passage (10) through which substance can pass from the container (not shown) into the metering chamber (8) and a valve stem (12) having a dispensing passage (14).

FIG. 1 shows the valve stem in its first (rest) position in which the dispensing passage (14) is isolated from the metering chamber (8). In the first position, the transfer passage allows communication between the container and the metering chamber. In accordance with the invention the transfer passage is provided with a flow valve in the form of an elastomeric 'O' ring (16) which is accommodated in a circumferential recess (18). The 'O' ring (16) seals the outlet (20) of the transfer passage. The seal is designed and fabricated such that it freely allows product to enter the metering chamber when the pressure of the formulation in the container is greater than the pressure within the metering chamber i.e. when the metering chamber is empty. The seal (16) provides a barrier against flow of product out of the metering chamber. Once the metering chamber is full and there is equalisation of pressure between the metering chamber and the container no further movement of product into or out of the metering chamber will occur.

The valve is actuated by movement of the valve stem (12) inwardly until there is communication between the dispensing passage (14) and the metering chamber (8). During the inward movement the seal (16) will pass out of the metering chamber, the chamber being isolated from the container by sealing engagement of the valve stem (12) with the tank seal (22). After actuation, when the valve stem is returned to its first position, formulation from the container will pass through the transfer passage (10), displacing the seal (16) and into the metering chamber (8).

FIG. 2 shows a similar construction of valve to that of FIG. 1. In accordance with the invention the flow valve in FIG. 2 is formed by a circumferential sealing band (24) on the tank seal (22). When the valve stem is in its first position as illustrated in FIG. 2, the band (24) covers the outlet (20) of the transfer passage (10). The band (24) is readily displaceable to allow transfer of substance from the container to the metering chamber when the pressure in the container is higher than that of the metering chamber. The band (24) acts as a barrier to prevent movement of substance from the metering chamber through the transfer passage (10).

FIGS. 3*a* and 3*b* illustrate cross-sections through the inner end of a metering chamber and valve stem suitable for use in a valve of the invention. FIG. 3*a* shows the valve stem (12) in its first position in which the metering chamber is full and the pressure in the metering chamber and container (not shown) are equal. The end of the valve stem (12) is shaped to define a transfer passage (10) between the tank seal (22) and the valve stem (12). The transfer passage (10) is closed by an elastomeric seal (26) which is secured to the end of the valve stem (12). As shown in FIG. 3*a,* the seal (26) engages the tank seal (22) preventing movement of material out of the metering chamber (8).

FIG. 3*b* shows the valve immediately after the valve stem has returned to its first position after actuation i.e. the metering chamber is empty. The pressure of the formulation in the container is higher than the pressure within the metering chamber (8) which causes the valve seal (26) to deflect away from the tank seal (22) opening the transfer passage (10). Thus, substance can freely pass from the container through the transfer passage (10) into the metering chamber as shown by the arrows in FIG. 3.

FIG. 4 represents a cross-section through the inner end of a metering chamber and valve stem suitable for use in a valve of the invention. The valve is shown in its first position. The valve stem (12) has a molded stem seal (30) secured to its end by a stem pin (32). The stem seal (30) is dimensioned to engage the tank seal (22) thereby blocking the transfer passage (10). The end of the valve stem (12) has a cut away portion (34) which allows displacement of the stem seal (30) when the pressure in the container is higher than that within the metering chamber thereby allowing free movement of substance through the transfer passage (10) into the metering chamber (8).

FIGS. 5*a* and 5*b* represent a cross-section and end view of the inner end of a metering chamber and valve stem. The embodiment is similar to that illustrated in FIG. 4 with the exception that the stem seal (30) is provided with additional support since the stem pin (32) is formed with a seal support plug (36). The transfer passage (10) is formed between the tank seal (22) and the seal support plug (36).

FIGS. 6*a* and 6*b* are similar views to FIGS. 5*a* and 5*b*. In this embodiment the plug (36) has the same diameter as the valve stem completely fills the aperture of the tank seal (22) but is provided with a plurality of holes (38) forming one or more transfer passages (10). In this embodiment, the seal (30) may form a seal by engagement with the tank seal (22) and/or the inner surface of the seal support plug (36).

FIGS. 7*a* and 7*b* are similar views to FIGS. 6*a* and 6*b*. In this embodiment the seal support plug (36) has the same diameter as the valve stem and completely fills the aperture of the tank seal (22). The seal support plug (36) is provided with a plurality of holes (38) forming one or more transfer passages (10). The seal (30) is a planar elastomeric ring and is located in a recess in the inner surface of the seal support plug and forms a seal by engagement with the inner surface of the plug. When the pressure in the container is higher than the pressure in the metering chamber, seal (30) is displaced from at least one transfer passage (10) thereby allow free movement of substance from the container through the transfer passage into the chamber (8).

FIGS. 8*a* and 8*b* are similar views to FIGS. 7*a* and 7*b*. In this embodiment the inner surface of the seal support plug (36) is bevelled and a position of the end of the valve stem (12) has a corresponding configuration. The seal (30) is in the form of a planar elastomeric ring which is forced to adopt a "v" configuration by being compressed between the valve stem and seal support plug thereby causing the seal to exert an elastic sealing force over the transfer passage. The mode of operation of the seal is as described with reference to FIGS. 7*a* and 7*b*.

What is claimed is:

1. A metered dose dispensing aerosol valve for a container comprising a valve body defining an aperture, a seal mounted at the aperture, a metering chamber, a tank seal, a transfer passage through which a quantity of substance to be dispensed can pass from the container into the metering chamber and a valve stem having a dispensing passage, the valve stem being moveable through the seal such that in a first position the dispensing passage is isolated from the metering chamber and the metering chamber is in communication with the container via the transfer passage and in a second position the dispensing passage is in communication with the metering chamber to allow substance to be dispensed from the metering chamber through the dispensing passage and the transfer passage is isolated from the metering chamber, and the valve stem extending, at least in said second position, through the tank seal, wherein the transfer passage comprises a mechanical flow valve positioned towards the end of the transfer passage adjacent the metering chamber, which in said first position, allows substance to be dispensed to pass from the container into the metering chamber but not out of the metering chamber.

2. A metered dose dispensing aerosol valve as claimed in claim 1 in which the transfer passage is formed within the valve stem and the flow valve comprises a displaceable seal which displaces to freely allow substance to enter the metering chamber but provides a barrier to substance in the metering chamber.

3. A metered dose dispensing aerosol valve as claimed in claim 2 in which the transfer passage has an outlet from the valve stem which is positioned within the metering chamber when the valve stem is in the first position and the displaceable seal is positioned at said outlet.

4. A metered dose dispensing aerosol valve as claimed in claim 3 in which the displaceable seal comprises an elastomeric sleeve or ring extending around the valve stem.

5. A metered dose dispensing aerosol valve as claimed in claim 2 in which the valve stem extends in the first position through the metering chamber in sealing engagement with the tank seal and said tank seal provides said elastomeric seal for the flow valve.

6. A metered dose dispensing aerosol valve as claimed in claim 1 in which the valve stem is in sealing engagement with a tank seal at least in said second position and the transfer passage is defined between the tank seal and valve stem when the valve stem is in the first position.

7. A metered dose dispensing aerosol valve as claimed in claim 6 in which the transfer passage is annular and the valve stem comprises an elastomeric stem seal secured to the valve stem which seals against the tank seal but is displaceable to allow passage of substance from the container through the transfer passage into the metering chamber.

8. A metered dose dispensing aerosol valve as claimed in claim 7 in which said elastomeric seal is positioned on an end of valve stem.

9. A metered dose dispensing aerosol valve as claimed in claim 1 in which the inner end of the valve stem has a seal support plug secured thereto, the seal support plug extending through a tank seal in sealing engagement therewith when the valve stem is in said first position, the sealing support plug having one or more apertures forming said transfer passage which are covered by a displaceable, annular elastomeric seal located between the top surface of the seal support plug and the inner end of the valve stem.

10. A metered dose dispensing aerosol as claimed in claim 9 in which the top surface of said seal support plug is planar and the annular elastomeric seal is planar.

11. A metered dose dispensing aerosol as claimed in claim 9 in which the top surface of the seal support plug is bevelled and the inner end of the valve stem has a corresponding configuration whereby the annular elastomeric seal is forced to adopt a "v" configuration by being compressed between the inner end of the valve stem and the seal support plug.

* * * * *